US006592120B2

(12) United States Patent
Kaya et al.

(10) Patent No.: US 6,592,120 B2
(45) Date of Patent: Jul. 15, 2003

(54) SIGNATURE REGISTER FOR A SIGNATURE REVERSING DEVICE

(75) Inventors: Mehmet Oktay Kaya, Lee, NH (US); Heiner Philipp Luxem, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 27 days.

(21) Appl. No.: 09/933,029

(22) Filed: Aug. 20, 2001

(65) Prior Publication Data

US 2002/0102120 A1 Aug. 1, 2002

Related U.S. Application Data

(60) Provisional application No. 60/265,728, filed on Feb. 1, 2001.

(51) Int. Cl.[7] ..... B65H 9/04
(52) U.S. Cl. ..... 271/243; 271/245; 271/246
(58) Field of Search ..... 271/245, 246, 271/247, 226, 243, 244

(56) References Cited

U.S. PATENT DOCUMENTS

| | | | | | |
|---|---|---|---|---|---|
| 1,340,723 | A | * | 5/1920 | Leonard | |
| 1,883,471 | A | * | 10/1932 | Barrett | |
| 2,251,943 | A | | 8/1941 | Kleinberg | 270/54 |
| 4,706,950 | A | | 11/1987 | Ruetschle et al. | 270/54 |
| 4,844,433 | A | | 7/1989 | Hastie | 270/54 |
| 5,253,861 | A | * | 10/1993 | Schmaling | |
| 5,263,705 | A | * | 11/1993 | Schmaling | |
| 5,301,938 | A | * | 4/1994 | Casper | |
| 5,934,668 | A | * | 8/1999 | Debarber et al. | |
| 5,947,469 | A | * | 9/1999 | Henn et al. | |

* cited by examiner

*Primary Examiner*—David H. Bollinger
(74) *Attorney, Agent, or Firm*—Davidson, Davidson & Kappel, LLC

(57) ABSTRACT

An apparatus for registering a signature moving along a surface, such as a drum, includes one or more pinch rollers for advancing the signature, and a register stop for stopping the advancement of the signature. The register stop is rotatable about an axis so as to accommodate skewing of the signature. The pinch rollers do not rotate with the register stop, but remained aligned with the drum.

19 Claims, 6 Drawing Sheets

SIGNATURE REGISTER FOR A SIGNATURE REVERSING DEVICE

This is a non-provisional application claiming priority to Provisional Application No. 60/265,728 filed on Feb. 1, 2001, which is hereby incorporated by reference herein.

BACKGROUND OF THE INVENTION

1. Field of the Invention

The present invention relates generally to signature feeders for print machines, and in particular, to a signature registering apparatus for a signature reversing device of a printing machine.

2. Background Information

Packaging, inserting, gathering, stapling and sewing machines receive signature or other paper products to be handled by way of a collection line on which these products are often formed by building them up from a plurality of individual elementary products. In order to form a periodical or a book, for example, a plurality of signatures is generally required. A signature is a printed sheet which has undergone at least one fold but may also indicate groups of printed sheets which are folded together at least once. A group of signatures is typically held in a hopper or feeder which contains the signatures that comprise the periodical or book. It becomes necessary during many handling operations to reverse the direction of signature. Reversing devices are therefore provided to accomplish this objective.

In prior reversing devices the trailing edge of a signature is gripped and removed from the hopper by gripping devices. The gripping devices are arranged on the periphery of a main drum and move the signature along the surface of the drum to a registering stop device via a nip formed between a pinch roller and the main drum. Once registered, the signature is then moved in the reverse direction along the surface of the main drum for further processing.

In order to accommodate skewing of the signature, the entire registration assembly, which includes the pinch roller, was required to rotate in prior reversing devices. Rotation of the entire registration assembly forces the pinch rollers out of alignment with the main drum, thus causing undesired wrinkling or folding of the signature.

SUMMARY OF THE INVENTION

The present invention to provides an apparatus for registering a signature moving along a surface in a first direction, the apparatus including: at least one pinch roller for advancing the signature in the first direction; and a register stop for stopping the advancement of the signature, wherein the register stop is rotatable about an axis so as to accommodate a skewing of the signature.

The surface may include a drum, with the pinch roller forming a nip with the drum and the signature passing into the nip.

The pinch roller may be fixedly aligned with the drum.

The register stop may include an end stop for registering the signature and for stopping the advancement of the signature.

The register stop may include an end stop for registering the signature and for stopping the advancement of the signature and may include a stop arm for guiding the signature to the end stop.

A register stop block rotatable about the axis may be provided, the register stop being mounted on the register stop block.

The signature may move along the surface using a propulsion device, which may include a gripper. The propulsion device may disengage the signature using the momentum of the signature.

The register stop may be mounted so that it is urged to return to a neutral position upon a rotation about the axis.

The present invention also provides a method for registering a signature moving along a surface in a first direction, the method including:

advancing the signature in the first direction using at least one pinch roller; and stopping the advancement of the signature using a register stop, the register stop being rotatable about an axis so as to accommodate a skewing of the signature.

In the present invention, the end stop block and end stop, but not the pinch roller, are rotated. Advantageously, the pinch roller provides a more uniform pushing of the signature into the registration assembly because the pinch roller remains aligned with the main drum. An improved registration and reversing operation, with reduced or eliminated wrinkling or folding of the signature, may thereby be effected.

BRIEF DESCRIPTION OF THE DRAWINGS

The present invention is elaborated upon below based on exemplary embodiments with reference to the accompanying drawings.

DETAILED DESCRIPTION

The terms used herein have the same meanings herein as in the printing industry and sciences. Likewise, it will be understood that the usefulness of the present invention is not limited to a particular print machine, although it is in connection with such that the invention hereof presently has principal usefulness.

Figure 1:
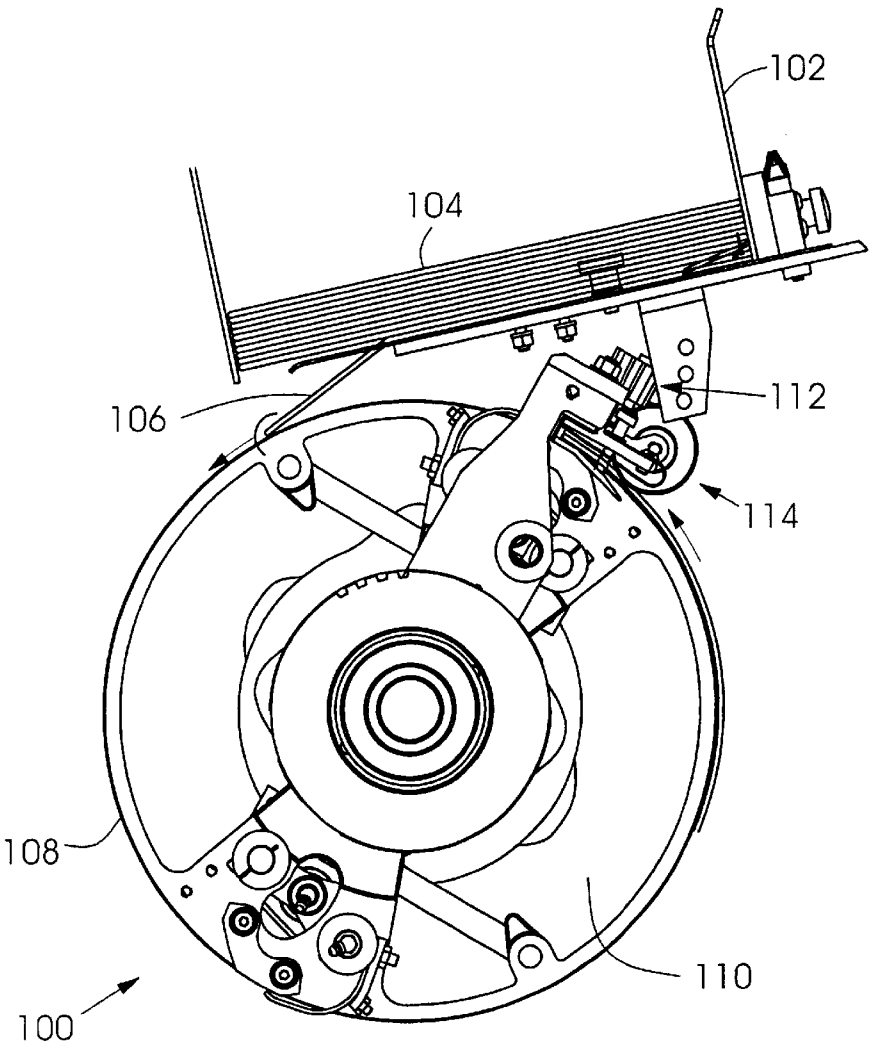
FIG. 1 shows a schematic side view of a signature feeder and drum, and registration apparatus in accordance with the present invention.

Referring now to the drawings wherein like reference numerals designate like or corresponding parts throughout different views, there is shown FIG. 1 a signature feeder 100 for use in a print machine having a hopper 102 which feeds a signature stack through the bottom thereof. A gripper (not shown) moves or propels the individual signatures 106 around the peripheral or circumferential surface 108 of a main drum 110 into a registration device 112. Print machines are well known in the art, with exemplary systems being the products manufactured by Web Systems of Heidelberger Druckmaschinen AG.

Figure 2:
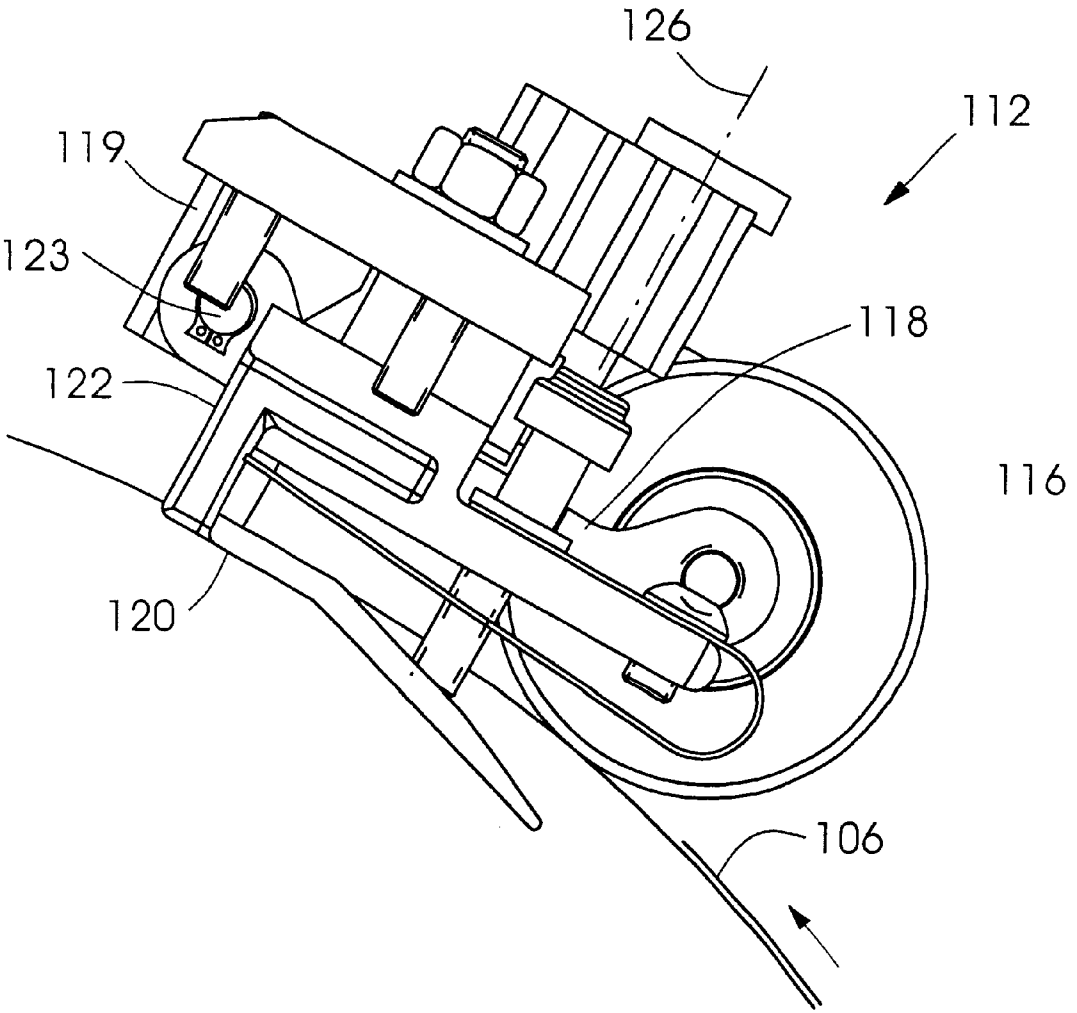
FIG. 2 shows a schematic side view of a pinch roller and registration apparatus in accordance with the present invention.
Figure 3:
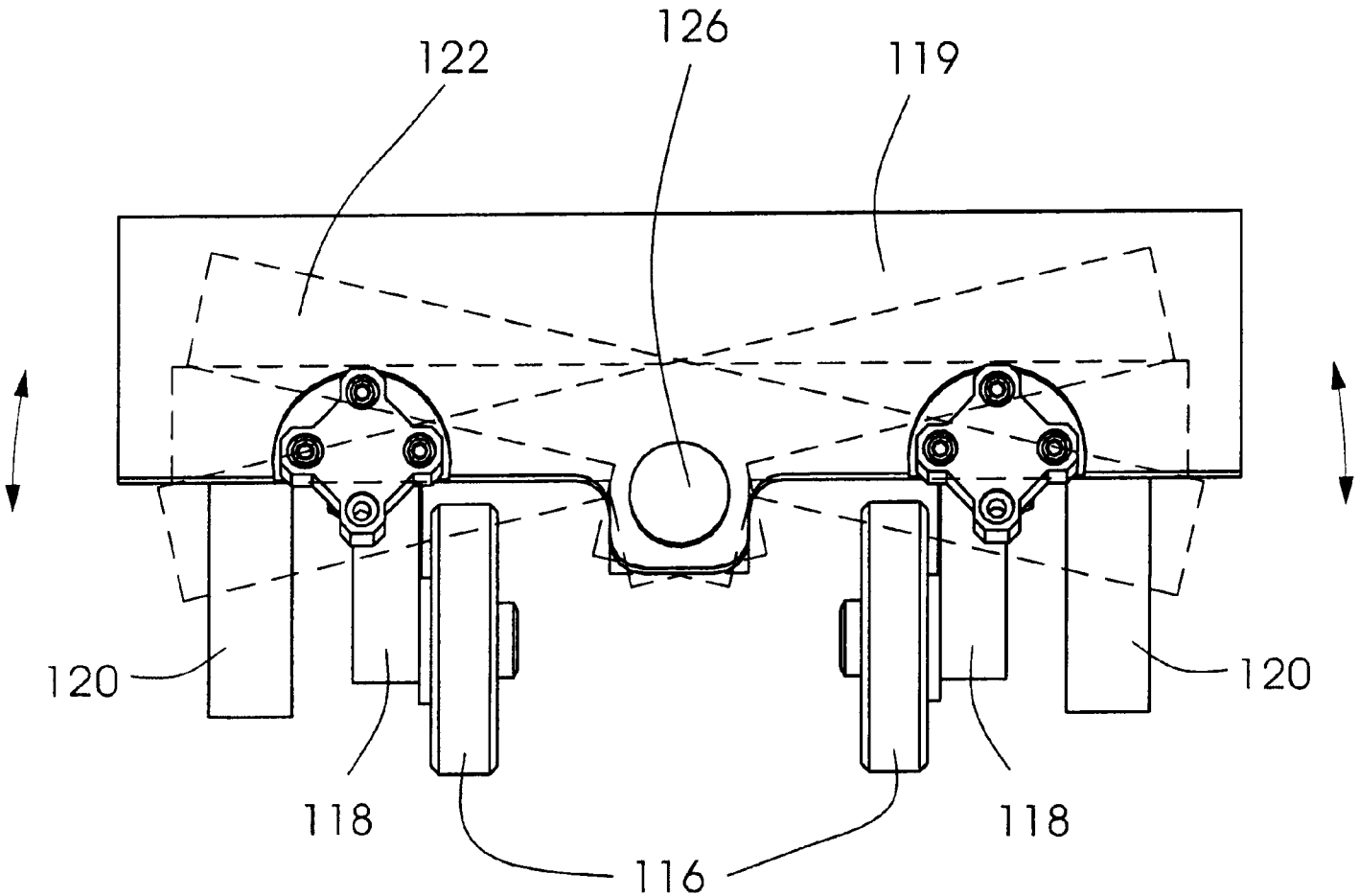
FIG. 3 shows a schematic top view of a registration apparatus in accordance with the present invention.
Figure 4:
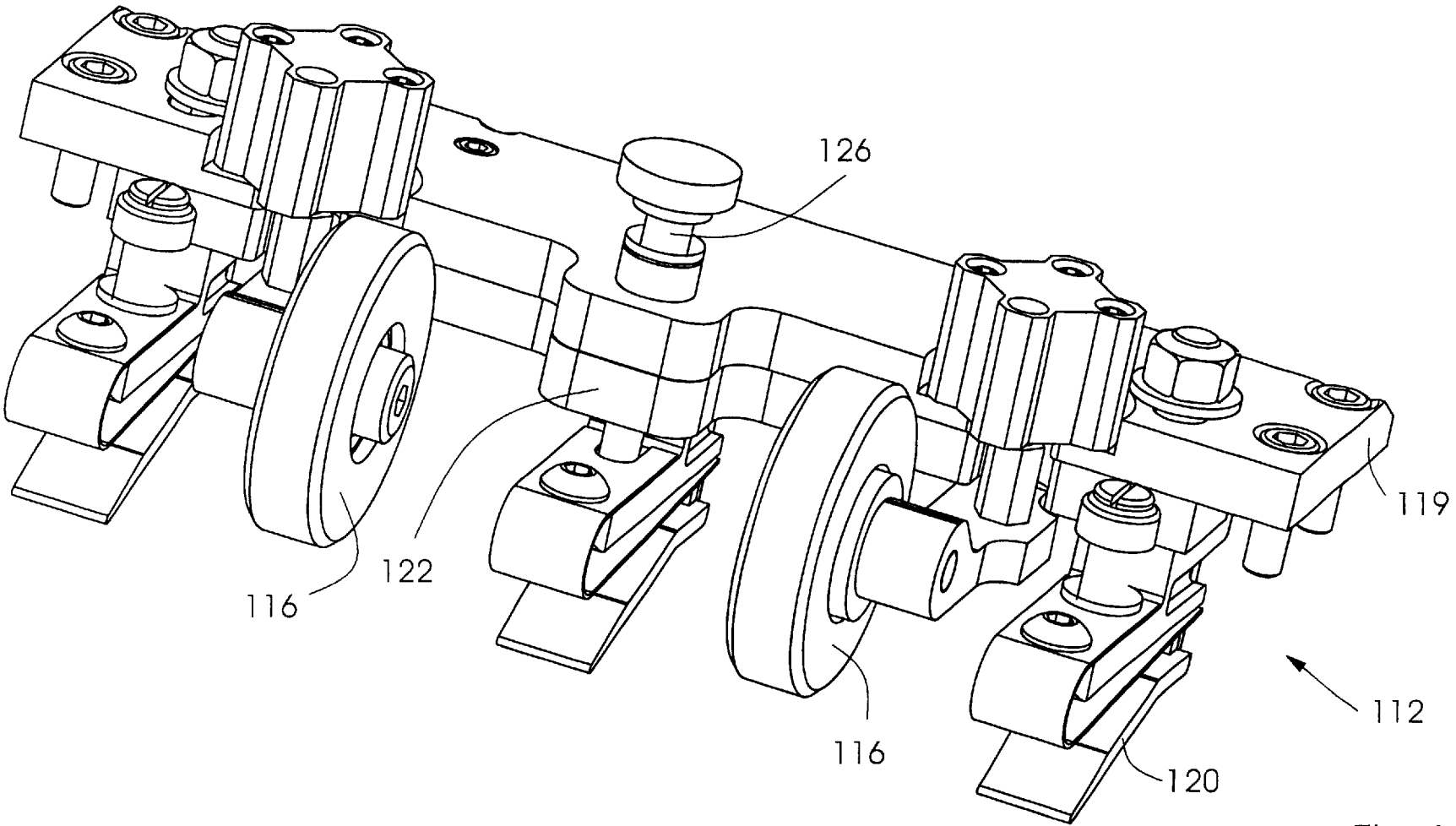
FIG. 4 shows a perspective view of a registration apparatus in accordance with the present invention.
Figure 5:
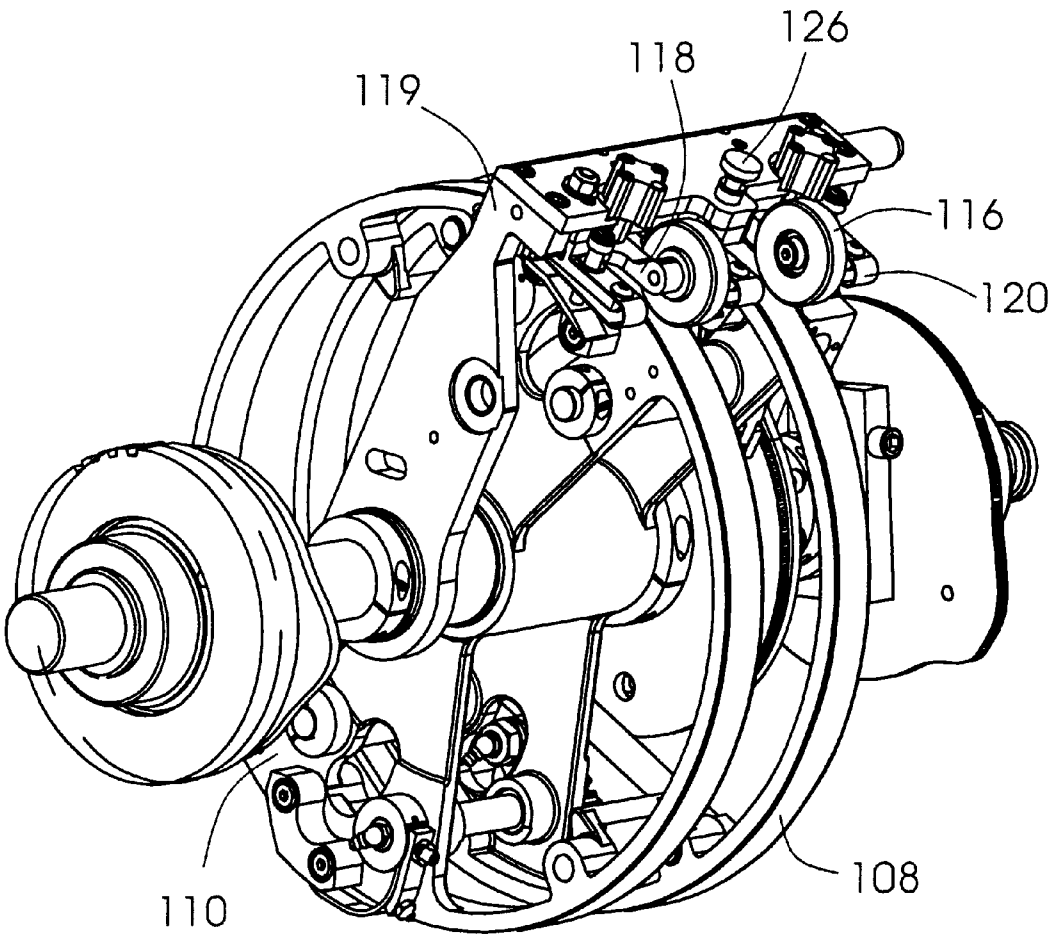
FIG. 5 shows a perspective view of a drum and registration apparatus in accordance with the present invention.
Figure 6:
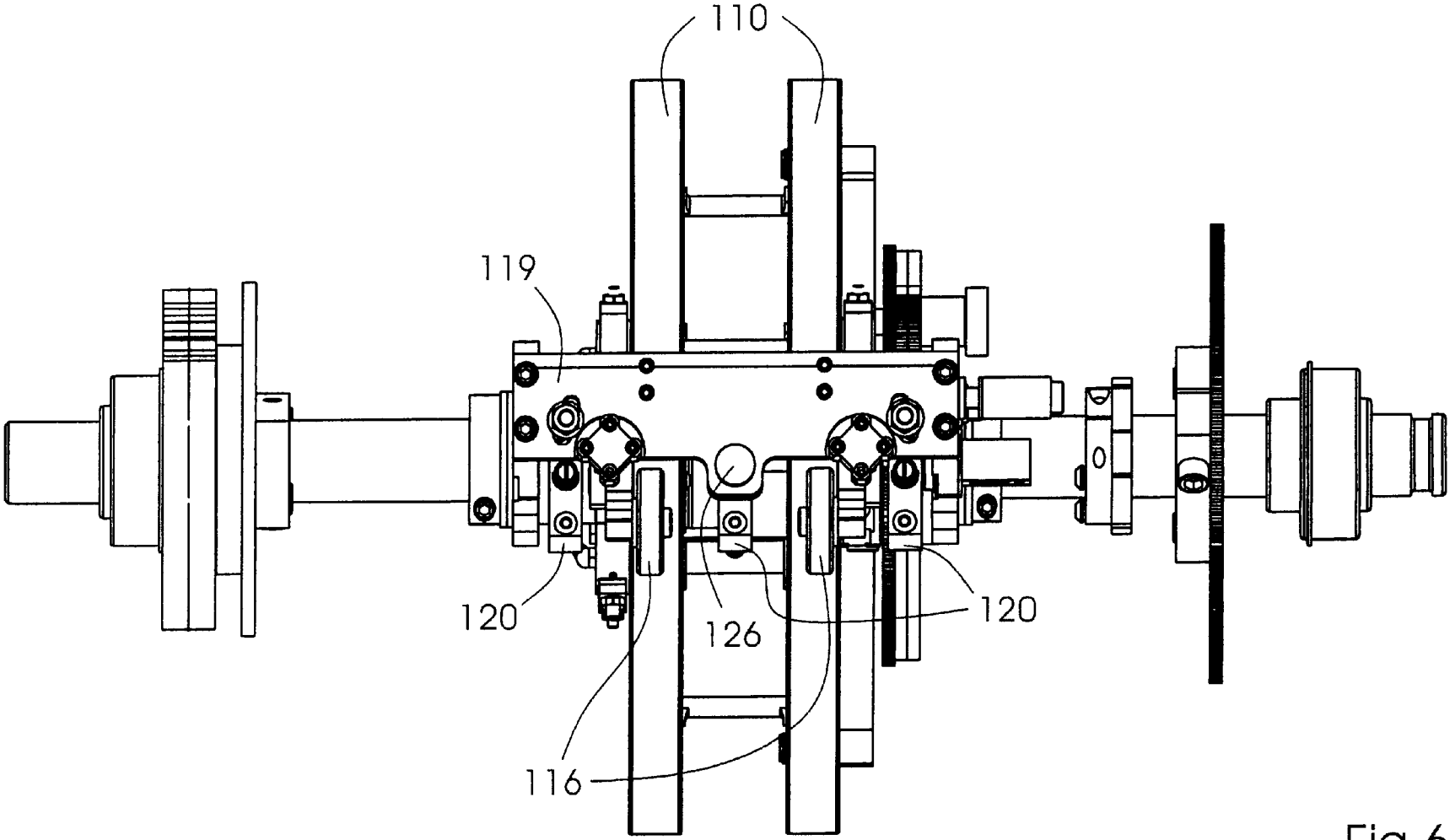
FIG. 6 shows a top plan view of a drum and registration apparatus in accordance with the present invention.

Referring now to FIG. 2, registration device 112 includes pinch roller assembly 114, register stop 120, and register stop block 122. Pinch roller assembly 114 includes pinch roller 116, pinch roller arm 118 and pinch roller block 119.

Pinch roller arm 118 pivots about axis 123 on pinch roller block 119. Signature 106 travels along the circumference of main drum 110 in the direction shown by the arrows and is picked up by pinch roller assembly 114. Pinch roller 116 applies pressure on the signature to create a nip with main drum 110. The signature is released by the gripping device into the nip and the momentum of the signature and the pinch roller carry the signature forward into register stop 120.

Register stop 120 serves to register the signature and stop it. Register stop 120 includes end stop arm 121 and end stop 124. End stop arm 121 guides the signature to end stop 124, which stops the signature. End stop arm 121 may be a flat, angled member as shown, or a member having any suitable shape. End stop 124 may have a flat stopping surface, as shown, or a surface of any suitable shape. Register stop 120 is mounted on register stop block 122. Register stop 120 and register stop block 122 pivot, or rotate, together about axis 126 relative to pinch roller assembly 114. Axis 126 may be any suitable pivot pin. Pinch roller assembly 114 does not rotate with register stop 120 and register stop block 122. Once registered, the direction of travel of the signature is changed, or reversed, and the signature is moved in the opposite direction circumferentially around main drum 110.

Referring now to FIGS. 3–6, there is shown registration device 112 having two pinch rollers 116 rotatably connected to pinch roller arms 118 which are pivotally rotatably connected to pinch roller block 119. Registration device 114 includes three register stops 120. In other embodiments of the present invention, different numbers of pinch rollers and/or registration stops may be provided. As can be seen in phantom, register stop block 122 and register stop 120 rotate about axis 126 which allows the register stop and the register stop block to skew themselves upon urging by the signature to accommodate the signature when it is skewed on main drum 110. Register stop block 122 may be torsion-loaded in any suitable manner, for example, spring loaded, about axis 126 so that the stop block, along with register stop 120, is urged to return to a neutral position in alignment with pinch roller block 119 when a skewed signature is moved away after being stopped and registered. Signature skewing can occur for a variety of factors, particularly when the two pinch rollers do not apply the same pressure on the signature against the main drum. Pinch rollers 116 preferably remain aligned relative to main drum 110.

It will of course be understood that the present invention has been described above only by way of example and that modifications of details should be understood by those skilled in the art and that various other changes, omissions and additions may be made therein and thereto without departing from the spirit and scope of the invention. For example, application of the present signature register would have equal applicability in conjunction with a signature moving on a flat or other surface rather than a circular drum as shown herein. Likewise, the pinch roller assembly might have different characteristics.

What is claimed is:

1. An apparatus for registering a signature moving along a surface in a first direction, the apparatus comprising:

at least one pinch roller for advancing the signature in the first direction; and a register stop for stopping the advancement of the signature, wherein the register stop is rotatable about an axis so as to accommodate a skewing of the signature;

wherein the surface includes a drum, the at least one pinch roller forming a nip with the drum, the signature passing into the nip.

2. The apparatus as recited in claim 1 wherein the at least one pinch roller is fixedly aligned with the drum.

3. The apparatus as recited in claim 1 wherein the register stop includes an end stop for the registering of the signature and for the stopping the advancement of the signature.

4. The apparatus as recited in claim 1 wherein the register stop includes an end stop for the registering of the signature and for the stopping the advancement of the signature and further includes a stop arm for guiding the signature to the end stop.

5. The apparatus as recited in claim 1 further comprising a register stop block rotatable about the axis, the register stop being mounted on the register stop block.

6. The apparatus as recited in claim 1 wherein the signature moves along the surface using a propulsion device.

7. The apparatus as recited in claim 6 wherein the propulsion device includes a gripper.

8. The apparatus as recited in claim 1 wherein the signature moves along the surface using a propulsion device, the propulsion device disengaging the signature using a momentum of the signature.

9. The apparatus as recited in claim 1 wherein the register stop is mounted so as to be urged to return to a neutral position upon a rotation about the axis.

10. An apparatus for registering a signature moving along a surface of a drum in a first direction in a signature reversing device, the apparatus comprising:

at least one pinch roller forming a nip with the drum for advancing the signature in the first direction, the at least one pinch roller maintaining an alignment with the drum; and a register stop for stopping the advancement of the signature, wherein the register stop is rotatable about an axis so as to accommodate a skewing of the signature.

11. A method for registering a signature moving along a surface in a first direction, the method comprising:

advancing the signature in the first direction using at least one pinch roller; and stopping the advancement of the signature using a register stop, the register stop being rotatable about an axis so as to accommodate a skewing of the signature.

12. The method as recited in claim 11 wherein the register stop includes an end stop for the registering of the signature and for the stopping the advancement of the signature.

13. The method as recited in claim 11 wherein the register stop includes an end stop for the registering of the signature and for the stopping the advancement of the signature and further includes a stop arm for guiding the signature to the end stop.

14. The method as recited in claim 11 wherein the register stop is mounted on a register stop block, the register stop block being rotatable about the axis.

15. The method as recited in claim 11 further comprising maintaining the at least one pinch roller fixedly aligned with the drum.

16. The method as recited in claim 11 wherein the signature moves along the surface using a propulsion device.

17. The method as recited in claim 16 wherein the propulsion device includes a gripper.

18. The method as recited in claim 11 further comprising moving the signature along the surface in a direction opposite the first direction.

19. The method as recited in claim 11 further comprising urging the register stop to return to a neutral position after a rotation about the axis.

* * * * *